US010794199B2

(12) United States Patent
Gaebler et al.

(10) Patent No.: US 10,794,199 B2
(45) **Date of Patent: *Oct. 6, 2020**

(54) ROTOR BLADE ASSEMBLY COMPRISING A RING SEGMENT SHAPED OR DISC SEGMENT SHAPED BLADE CARRIER AND A RADIALLY INNER REINFORCEMENT STRUCTURE

(71) Applicant: Rolls-Royce Deutschland Ltd & Co KG, Blankenfelde-Mahlow (DE)

(72) Inventors: Miklos Gaebler, Potsdam (DE); Sven Brueggmann, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 33 days.

This patent is subject to a terminal disclaimer.

(21) Appl. No.: 15/729,793

(22) Filed: Oct. 11, 2017

(65) Prior Publication Data

US 2018/0100402 A1 Apr. 12, 2018

(30) Foreign Application Priority Data

Oct. 12, 2016 (DE) ..... 10 2016 219 818

(51) Int. Cl.
*B63H 1/20* (2006.01)
*F01D 5/30* (2006.01)
(Continued)

(52) U.S. Cl.
CPC ..... *F01D 5/3069* (2013.01); *F01D 5/022* (2013.01); *F01D 5/066* (2013.01); *F01D 5/3007* (2013.01);
(Continued)

(58) Field of Classification Search
CPC ..... F01D 5/3069; F01D 5/022; F01D 5/066; F01D 5/3007; F05D 2220/32; F05D 2240/90; F05D 2260/31; F05D 2300/6032
(Continued)

(56) References Cited

U.S. PATENT DOCUMENTS 1,178,452 A 4/1916 London
1,325,208 A 12/1919 Rice
(Continued)

FOREIGN PATENT DOCUMENTS

DE 10163951 * 12/2002 ..... F01D 21/045
DE 10163951 C1 12/2002
(Continued)

OTHER PUBLICATIONS

European Search Report dated Feb. 12, 2018 from counterpart European App No. 17195634.5.
(Continued)

*Primary Examiner* — Hung Q Nguyen
*Assistant Examiner* — Anthony Donald Taylor, Jr.
(74) *Attorney, Agent, or Firm* — Shuttleworth & Ingersoll, PLC; Timothy J. Klima

(57) ABSTRACT

A rotor blade assembly group for an engine with at least one blade carrier having at least one rotor blade that is provided with multiple rotor blades along a circle line about a central axis of the rotor blade assembly group, wherein the blade carrier has a carrier section that extends radially inwards in the direction of the central axis with respect to the rotor blade, the carrier section comprises a connection area at which a stiffening structure with at least two, first and second, stiffening elements is fixedly attached, and the stiffening element is arranged at a first face side of the blade carrier, and the second stiffening element is arranged at a second face side that is facing away from the first face side.
(Continued)

The blade carrier is formed in a ring-segment-shaped or disc-segment-shaped-manner.

7 Claims, 8 Drawing Sheets

(51) Int. Cl.
*F01D 5/06* (2006.01)
*F01D 5/02* (2006.01)

(52) U.S. Cl.
CPC ..... *F05D 2220/32* (2013.01); *F05D 2240/90* (2013.01); *F05D 2260/31* (2013.01); *F05D 2300/6032* (2013.01)

(58) Field of Classification Search
USPC ..... 416/204 R
See application file for complete search history.

(56) References Cited

U.S. PATENT DOCUMENTS 3,501,249 A * 3/1970 Scalzo ..... F01D 5/3015 416/95
3,610,772 A * 10/1971 Wagle ..... F01D 5/06 416/198 A
3,610,777 A * 10/1971 Wagle ..... F01D 5/06 416/198 A
3,656,864 A * 4/1972 Wagle ..... F01D 5/22 415/174.4
3,765,796 A * 10/1973 Stargardter ..... F01D 5/282 416/218
3,787,141 A * 1/1974 Walsh ..... F01D 5/282 416/230
3,813,185 A * 5/1974 Bouiller ..... F01D 5/06 415/173.7
5,174,720 A * 12/1992 Gradl ..... F01D 5/3023 416/204 A
5,400,505 A * 3/1995 Wei ..... B22F 3/15 29/460
5,632,600 A * 5/1997 Hull ..... F01D 5/06 416/198 A
5,660,526 A * 8/1997 Ress, Jr. ..... F01D 5/02 416/198 A
6,213,720 B1 * 4/2001 Farmer ..... F01D 5/021 416/198 A
6,991,433 B2 * 1/2006 Mons ..... F01D 5/06 416/201 R
7,011,490 B2 * 3/2006 Albrecht ..... F01D 21/045 415/174.4
7,811,062 B1 * 10/2010 Twigg ..... F01D 5/147 416/218
7,918,644 B2 * 4/2011 Schreiber ..... F01D 5/06 415/199.5
2008/0025844 A1 * 1/2008 Bayer ..... C22C 47/00 416/221
2010/0189562 A1 7/2010 Blanchard et al.

FOREIGN PATENT DOCUMENTS

DE 10218459 B3 1/2004
DE 10358421 A1 7/2005

OTHER PUBLICATIONS

German Search Report dated Sep. 26, 2017 for counterpart German Application No. DE 10 2016 219 818.1.
German Search Report dated Sep. 28, 2017 for related German App. No. DE 102016319815.7.
European Search Report dated Feb. 12, 2018 from related European App No. 17195629.5.

* cited by examiner

ROTOR BLADE ASSEMBLY COMPRISING A RING SEGMENT SHAPED OR DISC SEGMENT SHAPED BLADE CARRIER AND A RADIALLY INNER REINFORCEMENT STRUCTURE

This application claims priority to German Patent Application DE102016219818.1 filed on Oct. 12, 2016, the entirety of which is incorporated by reference herein.

BACKGROUND

The invention relates to a rotor blade assembly group for an engine with a blade carrier with multiple rotor blades.

Such a rotor blade assembly group can for example be part of a compressor or a turbine of the engine, in particular of a gas turbine engine. Here, the rotor blades are provided along a circle line about a central axis of the rotor blade assembly group, wherein this central axis usually coincides with the rotational or central axis of the engine. The blade carrier, at which the rotor blades are integrally formed or at which separately manufactured rotor blades are fixated via respectively one blade root, has a carrier section that extends radially inwards in the direction of the central axis with respect to the rotor blades. This carrier section usually forms a part of a disc body, which is formed—in consideration of the available installation space—with a comparatively large surface, so as to be able to withstand the loads that result from the fast rotation of the rotor blade assembly group about the central axis as they occur during operation of the engine. The higher the rotational speed of the blade carrier with the rotor blades and thus the load on the blade carrier, the larger the carrier section and consequently the weight of the blade carrier.

What is proposed in DE 101 63 951 C1 and DE 102 18 459 B3 for reducing the weight of a rotor blade assembly group and a rotor comprising the same is to provide a stiffening structure with first and second stiffening elements made of a metal matrix composite ("MMC", in short) at the blade carrier, which is ring-shaped or disc-shaped in the present case, at a connection area of the carrier section. At that, respectively one stiffening element is embodied as a fiber-reinforced MMC ring and is arranged at respectively one face side of the blade carrier. Thus, for example two MMC rings are fixedly attached in a mirror-inverted manner at a connection area of a radially inwardly extending carrier section of a blade carrier, and namely at a first frontal face side and at a second rear face side of the blade carrier. Through the additional stiffening elements in the form of MMC rings, higher rotational speeds can be applied to the blade carrier while the carrier section has a smaller radial extension, and thus the blade carrier can be subjected to higher loads. Thanks to the MMC rings, the weight of the blade carrier is considerably lower as compared to a blade carrier with the same loadability having a larger carrier section.

In the rotor blade assembly groups that are proposed in DE 101 63 951 C1 and DE 102 18 459 B3, the stiffening elements in the form of the MMC rings are fixated independently of each other in a form-fit manner at respectively one face side of the carrier section, and where necessary additionally shrunk onto an axially extending projection of the connection area. At that, each MMC ring is separately axially secured at the respective face side of the carrier section and arranged above the corresponding axially extending projection at the connection area of the carrier section with respect to a radially outwardly pointing transverse direction. The fixation and in particular axial securing of the individual stiffening elements in the form of MMC rings is thus comparatively laborious. Further, the manufacture of the blade carrier with the connection area, which has to additionally integrate a form-fit axial securing possibility, is complicated and entails relatively high costs.

SUMMARY

The invention is thus based on the objective to provide a rotor blade assembly group that is improved in this respect, and in which the previously mentioned disadvantages are avoided or at least reduced.

This objective is achieved with a rotor blade assembly groups with features as described herein.

What is proposed according to a first aspect of the invention is a rotor blade assembly group for an engine with a ring-segment-shaped or disc-segment-shaped blade carrier having at least one rotor blade, in which at least two, first and second, stiffening elements of a stiffening structure, which is fixedly attached at a connection area of a carrier section of a blade carrier, are respectively connected not only to the connection area, but in which the first and second stiffening elements are in addition also connected to each other.

Through the additional connection of the stiffening elements, which are arranged at different face sides of the blade carrier, an axial securing of the stiffening elements at each other and with respect to the blade carrier is achieved, without each individual stiffening element itself having to be separately axially secured at the carrier section of the blade carrier. Here, according to the first aspect of the invention, the solution according to the invention is based on the basic idea that, at the connection area of the blade carrier, stiffening elements are arranged at first and second face sides of the blade carrier that are facing away from each other—with the stiffening elements being preferably embodied so as be symmetrical to a transverse direction that extends radially with respect to the central axis and so as to be facing each other—, and that are axially secured through their additional connection to each other (with respect to the central axis).

Here, in one embodiment variant, the axial securing of both stiffening elements of the stiffening structure is realized via at least one connection appliance with at least one separate connection element that directly connects the two stiffening elements arranged at different face sides, and secures them axially with respect to each other. In this manner, none of the stiffening elements is axially displaceable relative to the other stiffening element. Both stiffening elements are thus supported at the carrier section in a position according to the intended use.

At that, the solution according to the invention is principally independent of whether the rotor blades are formed integrally with the blade carrier, and the rotor blade assembly group is thus realized in Bling or Blisk design, or whether the rotor blades are separately manufactured and fixated at the blade carrier. In one embodiment variant, the ring-segment-shaped or disc-segment-shaped blade carrier is for example formed integrally with at least one rotor blade.

In one embodiment variant, a previously mentioned separate connection element for the connection of the first and second stiffening elements, which are arranged at different face sides of the blade carrier, to each other extends through a passage hole in the carrier section. This passage hole can be a central passage hole through the blade carrier, for example in the form of a bore, through the blade carrier above the connection area, i.e. a passage hole, which is arranged at a distance to the connection area in a radially outwardly oriented direction. In that case, the at least one separate connection element for example extends through such a central passage hole of the blade carrier, so as to axially fixate the two stiffening elements relative to each other. Through the at least one connection element of the connection appliance extending through the carrier section, it is not only possible to fixate the two stiffening elements at each other, but also to fixate two stiffening elements at the carrier section.

In one embodiment variant, the at least one separate connection element of the connection appliance extends through a connection opening in the carrier section to connect the first and second stiffening elements with each other. At that, the connection element can for example be embodied in the form of a stud bolt and further extend through respectively one radially projecting connecting web of the first and second stiffening elements. In this manner, it can also be provided in a further development that a rotor blade assembly group comprises ring-segment-shaped or disc-segment-shaped blade carriers that are arranged next to each other along a circumferential direction about the central axis and that respectively have at least one rotor blade connected at each face side with a common stiffening element of the stiffening structure (for example having a ring-shaped design) by means of multiple bolt connections. In this way, the connection appliances of the rotor blade assembly group do not only serve for fixating the two first and second stiffening elements to each other, but at the same time for the fixation of the two first and second stiffening elements at multiple ring-segment-shaped or disc-segment-shaped blade carriers, and a coupling of the individual ring-segment-shaped or disc-segment-shaped blade carrier to each other. Consequently, an anti-rotation appliance for the stiffening elements on the one hand and the blade carriers on the other hand is also provided in this way.

In one embodiment variant, the connection appliance of the rotor blade assembly group is configured and provided for connecting the rotor blade assembly group to a connection component via which the rotor blade assembly group is connected in a torque-proof manner to another rotor blade assembly group that is arranged in an axially offset manner within the engine along the central axis axial. In this way, individual rotor blade rows, that are formed by the respectively one rotor blade assembly group, are arranged behind each other and connected to each other in a torque-proof manner in a multi-stage compressor or in a multi-stage turbine of the engine. Now, in the previously mentioned embodiment variant, a connection component for the torque-proof connection of individual rotor blade rows that are axially offset with respect to one another is fixated at the blade carrier precisely by means of that connection appliance which is also used for connecting and preferably fixating the two first and second stiffening elements that are arranged on different face sides of the blade carrier at each other as well as at the blade carrier.

Here, the connection component is for example formed in a sleeve-shaped manner and with respectively one ring-shaped mounting flange at each face side, via which the connection component is fixated at a blade assembly group. Alternatively, multiple connection components that are respectively embodied in a sleeve-shaped manner can be provided to connect two rotor blade rows respectively in the area of a ring-segment-shaped or disc-segment-shaped blade carrier or respectively in the area of multiple ring-segment-shaped or disc-segment-shaped blade carriers in a torque-proof manner.

In one possible variant, a separate connection element of the connection appliance, for example a plug or stud bolt, extends through a connection opening in the carrier section as well as through a connection opening in the connection component. For example, the connection opening of the connection component can be a through-hole in a flange section of the connection component.

In one embodiment variant, it is provided that at least the first or second stiffening element is formed in a ring-shaped manner. In a further development, both stiffening elements are formed in a ring-shaped manner. Compared to multiple, for example ring-segment-shaped, stiffening elements per face side, the ring-shaped design of one individual stiffening element per face side has the advantage that it is simpler and quicker to assemble.

In one embodiment variant, at least one of the first and second stiffening elements is manufactured at least partially from a metal matrix composite ("MMC", in short) for the purpose of weight reduction. Here, at least one of the first and second stiffening elements can have a core of a metal matrix composite provided with an exterior coating. The core may for example consist of a reinforced titanium in MMC design, i.e., in particular of a titanium matrix with a ceramic reinforcement.

In one embodiment variant, the blade carrier at the rotor blade assembly group—together with further ring-segment-shaped or disc-segment-shaped blade carriers—defines a passage that extends axially with respect to the central axis axial and that is radially delimited by the inner edges of the carrier sections of the individual blade carriers. A section of the first or second stiffening element made of a metal matrix composite extends axially below such an inner edge of the carrier section of a ring-segment-shaped or disc-segment-shaped blade carrier. Accordingly, it is provided in such a variant that the radially inner edge of the carrier section, which delimits the preferably centrally provided passage hole of the rotor blade assembly group, is at least partially edged by the at least one stiffening element, for example with an L-shaped cross section, and a section of the stiffening element extends below the connection area with respect to a radially outwardly oriented transverse direction. Consequently, the section of the first or second stiffening element arranged at the first or second face side, which is made of a metal matrix composite, extends below the inner edge in the direction of the other face side, and consequently provides a support below this inner edge through the metal matrix composite. The extension of the metal matrix composite in the axial direction below an inner edge of the carrier section can thus serve to provide an additional support below the rotor blades and the thus formed circumferentially extending rotor blade row, and result in a more robust stiffening structure.

In one embodiment variant, the connection area forms at least one axial projection that is enclosed by a first or second stiffening element in a form-fit manner, so that the axial projection is received at least partially between a radially outer and a radially inner section of this stiffening element. In this way, an axially projecting section of the connection area extends between a radially outer and a radially inner section of the stiffening element. At that, the axial projection can for example be formed at the connection area so as to project locally in a web-like manner or so as to project circumferentially in a ring-segment-shaped manner, and can for example be received between the two sections of the stiffening element inside a groove-shaped recess of the stiffening element. The form-fit enclosing of an axial projection of the connection area by at least one of the stiffening elements does not only allow for an improved force application into and support through the respective stiffening element, but also an improved connection of the respective stiffening element to the connection area of the blade carrier. In this manner, the stiffening element can for example be axially pushed on or plugged on in a simple manner at the face side of the blade carrier and the at least one axial projection, and is held at the blade carrier in a directly radially secured manner by means of the form-fit enclosing of the axial projection.

Alternatively or additionally to a form-fit enclosing of an axial projection of the connection area, the blade carrier together with further ring-segment or disc-segment-shaped blade carriers of the rotor blade assembly group can have a passage hole that extends axially with respect to the central axis and that is radially delimited by an inner edge of the carrier section, and a first or second stiffening element of the stiffening structure can extend axially with at least one section below this inner edge of the connection area. Thus, in that case, a first or second stiffening element of the stiffening structure extends with at least one section axially along the inner edge of the connection area from one face side in the direction of the other face side of the blade carrier. Through the extension of the stiffening element below the radially inner edge of the blade carrier, an improved support and stiffening of the blade carrier in the area of the carrier section can be achieved independently of the use of the metal matrix composite—and in particular independently of the design explained above, in which a section of the stiffening element made of a metal matrix composite extends axially below an inner edge.

Also, the design of at least one axial connection area that is enclosed by the stiffening element in a form-fit manner as well as the axial extension of at least one section of a first or second stiffening element below an inner edge of the connection area for improving the mountability of the stiffening structure and the loadability of the blade carrier can be advantageously combined with an additional connection of the first and second stiffening elements arranged at different face sides of the blade carrier, but can also be used independently therefrom.

Accordingly, what is proposed according to a second aspect of the invention is a rotor blade assembly group for an engine with at least one ring-segment-shaped or disc-segment-shaped blade carrier having at least one rotor blade, in which a stiffening structure is provided that has at least one stiffening element at a first or second face side of the blade carrier. At that, the connection area according to the second aspect of the invention forms at least one axial projection that is enclosed by the at least one stiffening element in a form-fit manner, so that the axial projection is received at least partially between a radially outer and a radially inner section of the stiffening element. Alternatively or additionally, it is provided according to the second aspect of the invention that the blade carrier has a passage hole that extends axially with respect to the central axis of the blade assembly group and that is radially delimited by an inner edge of the carrier section, and the at least one stiffening element of the stiffening structure extends with at least one section axially below this inner edge of the connection area, that is, from the face side in the direction of the other face side.

An axial projection of the connection area can principally extend in parallel to the central axis and thus substantially perpendicular to a radially extending face side of the carrier section. However, the axial projection can also take an angle to the face side that is different from 90°.

Further, a transitional area between a substantially radially extending face-side carrier surface at the connection area and an end of the projection integrally formed therewith can be curved in a concave manner. Here, the degree of curvature and thus the course of a straight line at this transitional area can be chosen differently depending on the engine and/or the position of the rotor blade assembly group, depending on how strong the forces occurring at the connection area are and with which force components they extend, for example radially and tangentially. For instance, at the transitional areas, a straight line extends at an angle of 0° to 45° with respect to the radial direction. The degree of curvature and thus the enclosed angle can for example also be realized depending on the used manufacturing material for the stiffening element. In particular with a view to a metal matrix composite and the fibers provided therein, which can bear higher stresses in the circumferential direction about the central axis than in a tangential direction, a smaller angle and thus a stronger concave curvature may be advantageous for the transitional area (and thus a less "soft" transition between the face surface and projection).

The at least one axial projection can be part of a profile of the connection area that has a T-shaped, I-shaped or firtree-shaped cross section. In a T-shaped profile, two projections that axially extend in opposite directions are integrally formed at the connection area. Accordingly, in a profile that is formed in an I-shaped manner, i.e., in the manner of the cross sectional profile of a double T-girder, two pairs of such two projections extending axially in opposite directions are provided, being arranged at a radial distance to one another. Provided in a firtree-shaped profile are at least two or three pairs of projections that extend axially in opposite directions and are arranged radially above and at a distance to each other, with their axial extension decreasing or increasing in a step-wise manner along a radial direction.

In one embodiment variant, a T-shaped, I-shaped or firtree-shaped profile of the connection area extends in the circumferential direction about the central axis. In a further development, the connection area of the ring-segment-shaped or disc-segment-shaped blade carrier is provided with a T-shaped, I-shaped or firtree-shaped profile that extends across the entire length of the blade carrier in the circumferential direction.

In particular in a firtree-shaped cross sectional profile of the connection area, a for example ring-segment-shaped stiffening element can be arranged at each face side of the blade carrier, being provided with a correspondingly matching cross sectional profile as a counter-part and enclosing multiple axial projections, which are defined by the firtree-shaped cross sectional profile of the connection area, in a form-fit manner. By means of such a connection between a respective stiffening element and the connection area of the blade carrier, the radial loads that occur during operation of the engine can be guided from the blade carrier into the stiffening structure more efficiently. Here, the occurring forces are also introduced into the stiffening structure at different radial positions and thus in a distributed manner, so that the force transmission between the blade carrier and the stiffening structure is improved. Also, the connection and safe fixation of the stiffening structure at the blade carrier is considerably simplified.

In a possible further development, sealing elements and/or cooling openings can be provided at an axial projection of the connection area, in particular at an axial projection of a T-shaped, I-shaped or firtree-shaped cross sectional profile of the connection area. In that case, cooling openings may for example serve for supplying cooling air to the blade carrier.

What can in particular be provided with a rotor blade assembly group of the invention, according to the first as well as the second aspect of the invention, is a gas turbine engine in which the weight of one or multiple rotor blade rows of a compressor and/or of one or multiple rotor blade rows of a turbine is considerably reduced as compared to the rotor blade rows as they have been commonly used so far in practice, while at the same time the mounting of the stiffening structure and its axial securing is comparatively simple. At that, rotor blade assembly groups that respectively form one rotor blade row, respectively including multiple ring-segment-shaped or disc-segment-shaped blade carriers and a stiffening structure fixedly attached thereat according to the invention, can be arranged axially behind each other and fixated at each other in a torque-proof manner, in particular via an axially extending connection component or multiple connection components that are connected to at least one stiffening element of a stiffening structure. However, of course it is also possible to combine a rotor blade assembly group embodied according to the invention for forming a rotor blade row with a further rotor blade assembly group of a further rotor blade row that is not embodied according to the invention.

BRIEF DESCRIPTION OF THE DRAWINGS

The accompanying Figures illustrate possible embodiment variants of the invention by way of example.

DETAILED DESCRIPTION

Figure 8:
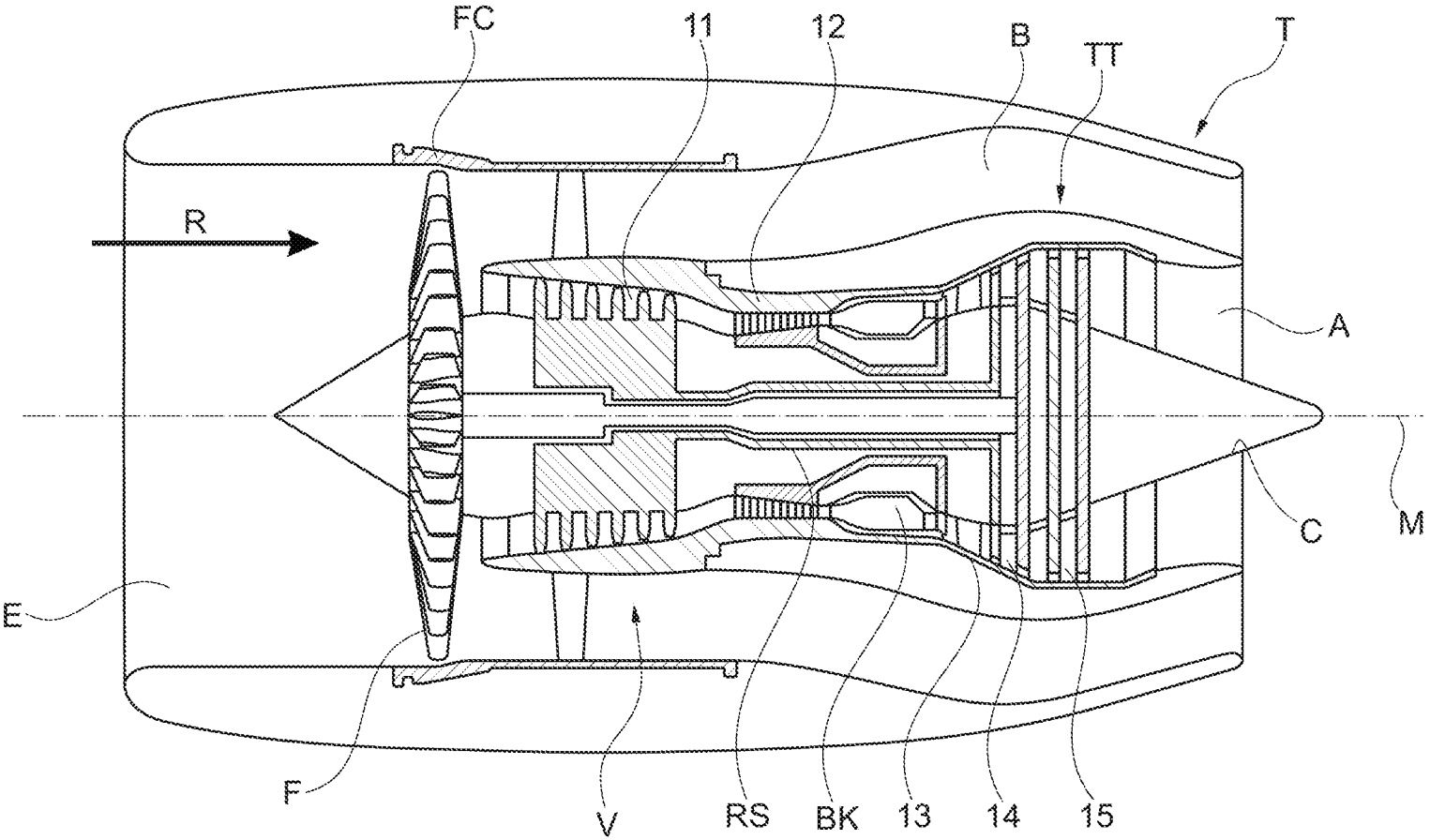
FIG. 8 shows a cross sectional view of a turbine engine in which one embodiment variant of a rotor blade assembly group according to the invention is used in the area of a compressor and/or in the area of a turbine.

FIG. 8 schematically illustrates, in a sectional rendering, a gas turbine engine T in which the individual engine components are arranged in succession along a rotational axis or central axis M, and in which the engine T is formed as a turbofan engine. By means of a fan F, air is suctioned in along an entry direction E at an inlet or an intake E of the engine T. This fan F, which is arranged inside a fan housing, is driven via a rotor shaft S that is set into rotation by a turbine TT of the engine T. Here, the turbine TT connects to a compressor V, which for example has a low-pressure compressor 11 and a high-pressure compressor 12, and where necessary also a medium-pressure compressor. The fan F supplies air to the compressor V, on the one hand, and, on the other hand, to a secondary flow channel or bypass channel B for generating the thrust. Here, the bypass channel B extends about a core engine that comprises the compressor V and the turbine TT, and also comprises a primary flow channel for the air that is supplied to the core engine by the fan F.

The air that is conveyed via the compressor V into the primary flow channel is transported into the combustion chamber section BK of the core engine where the driving power for driving the turbine TT is generated. For this purpose, the turbine TT has a high-pressure turbine 13, a medium-pressure turbine 14, and a low-pressure turbine 15. The turbine TT drives the rotor shaft S and thus the fan F by means of the energy that is released during combustion in order to generate the necessary thrust by means of the air that is conveyed into the bypass channel B. The air from the bypass channel B as well as the exhaust gases from the primary flow channel of the core engine are discharged via an outlet A at the end of the engine T. Here, the outlet A usually has a thrust nozzle with a centrally arranged outlet cone C.

As is known, rotor blade assembly groups which rotate about the central axis M and respectively have one rotor blade row and in which the rotor blades are provided at a ring-shaped or disc-shaped blade carrier, are used in the area of the (axial) compressor with its low-pressure compressor 11 and its high-pressure compressor 12 as well as in the area of the turbine TT. In principle, the ring-shaped or disc-shaped blade carrier can be integrally bladed, and can thus be manufactured in Bling or Blisk design. Alternatively, it is possible to fixate individual rotor blades at a ring-shaped or disc-shaped blade carrier via their respective blade roots. For this purpose, a blade root may for example be axially inserted into a fastening groove of the blade carrier and axially secured at the respective blade carrier.

Figure 7:
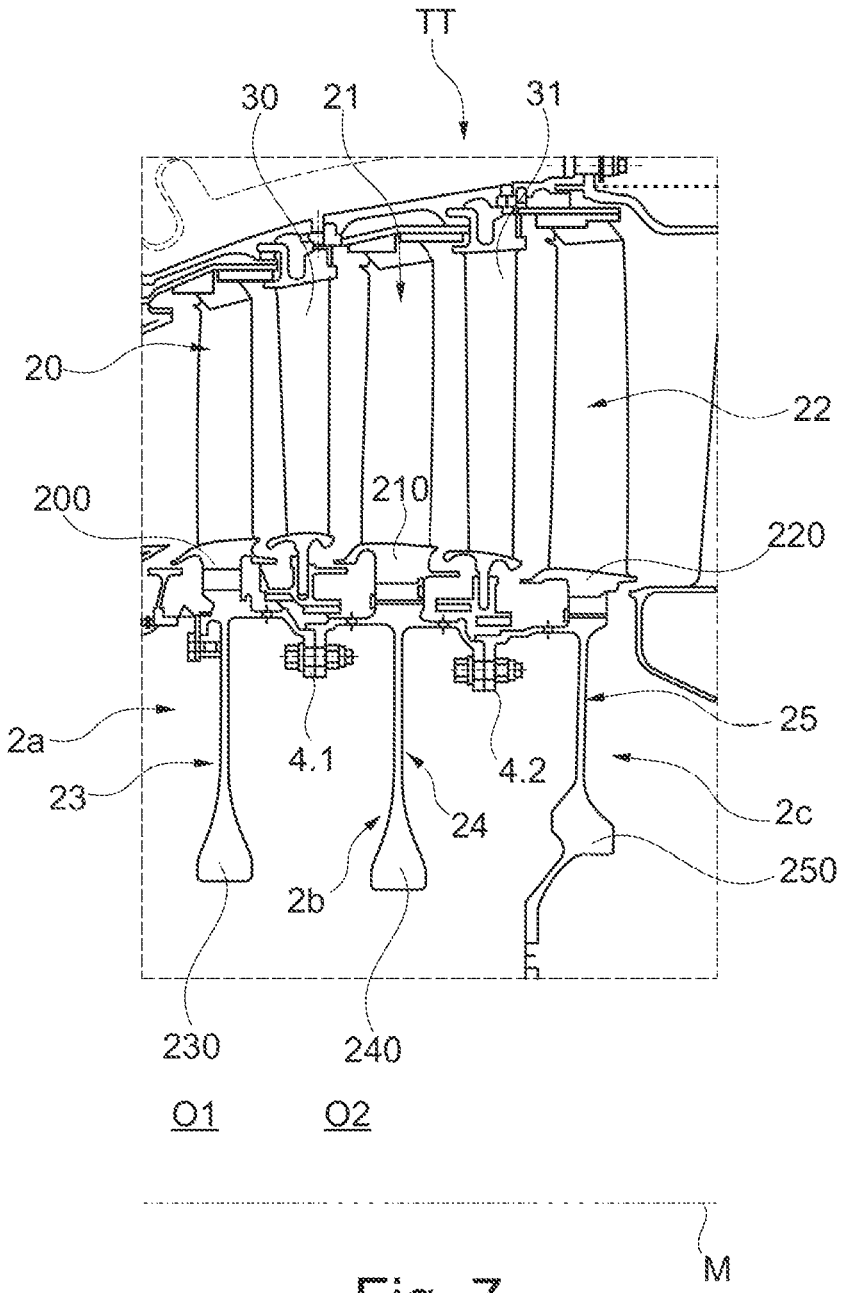
Fig. 7 Prior Art
FIG. 7 shows, by sections and in sectioned rendering, an embodiment of rotor blade rows of a turbine of a gas turbine engine as it is known from the state of the art.

By way of example, FIG. 7 illustrates multiple rotor blade assembly groups 2*a*, 2*b* and 2*c* of the turbine TT arranged behind each other along the central axis M. Here, the section that is shown in FIG. 5 depicts only a part above the central axis M in the area of the medium-pressure turbine 14 or the low-pressure turbine 15. The individual rotor blade assembly groups 2*a*, 2*b* and 2*c* are connected to each other in a torque-proof manner via flange connections 4.1 and 4.2. Further, each rotor blade assembly group 2*a*, 2*b* and 2*c* has respectively one ring-shaped or disc-shaped blade carrier 23, 24 or 25, at which individual rotor blades 20, 21 or 22 of a blade row are arranged behind each other along a circle line about the central axis M, and are fixated at the respective blade carrier 23, 24 or 25 via a blade root 200, 210 or 220 of a rotor blade 20, 21 or 22. In the axial direction along the central axis M, rotor blade rows of the rotor blade assembly groups 2*a*, 2*b* and 2*c* alternate with stationary guide vane rows. The guide vane rows respectively have guide vanes 30 or 31 that are also arranged along the entire circumference on a circle line extending about the central axis M.

Due to the rotational speeds and the resulting loads, each blade carrier 23, 24 or 25 of a rotor blade assembly group 2*a*, 2*b* or 2*c* of the state of the art has a radially inwardly extending carrier section 230, 240 or 250. A disc-shaped carrier section 250 of the rear rotor blade assembly group 2*c* for example serves for the rotatable mounting of the rotor blade assembly groups 2*a*, 2*b* and 2*c* that are connected to one another in a torque-proof manner. In the carrier section 230, 240 of two (with respect to the flow direction through the engine T) frontal rotor blade assembly groups 2*a* and 2*b*, a central passage hole O1 or O2 is provided mainly for the purpose of weight reduction, for example in the form of a bore. With view to the necessary installation space of the rotor blade assembly groups 2*a* and 2*b* as well as their weight, it is primarily important which radial extension the blade carriers 23 and 24 have in order to be able to withstand the loads that occur during operation.

Figure 1:
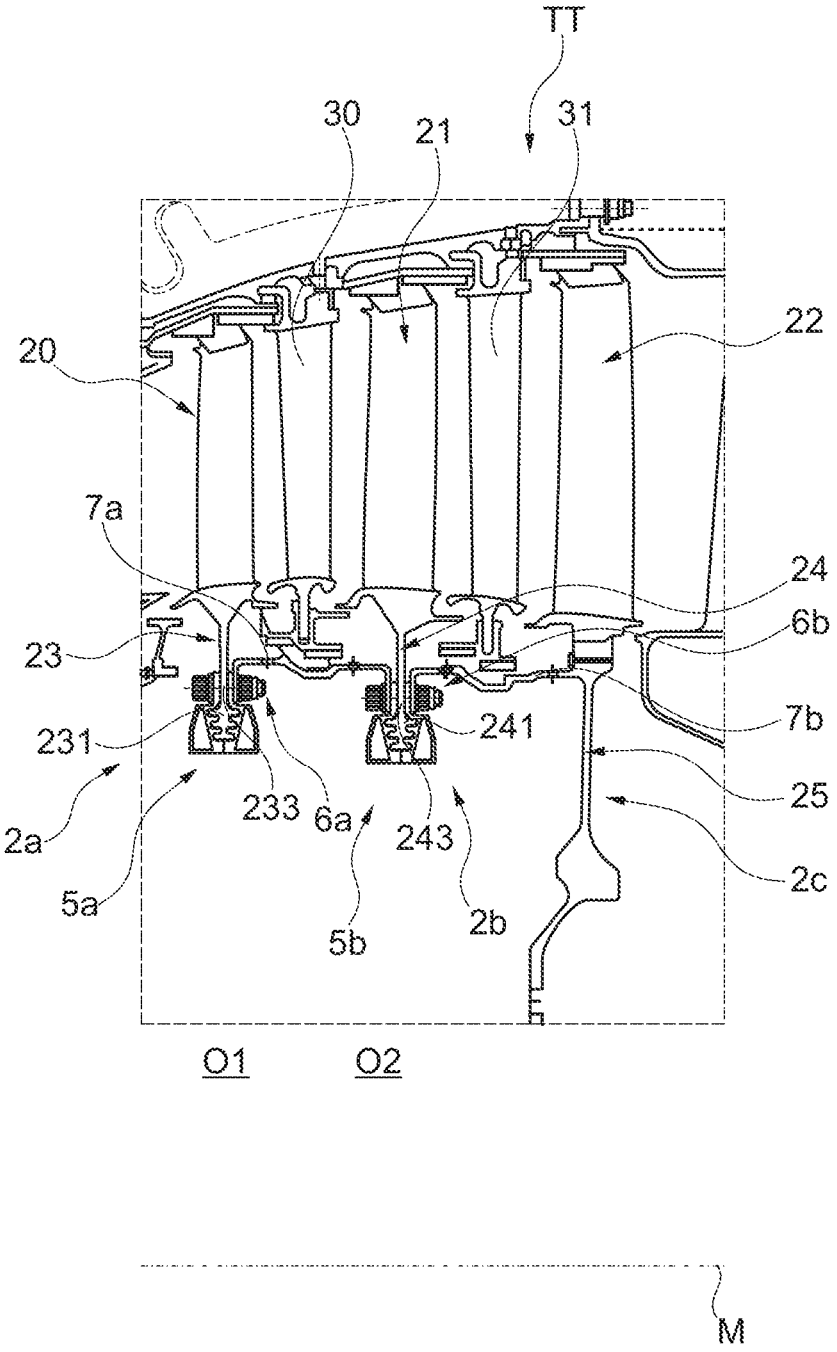
FIG. 1 shows, by sections and in a sectional rendering, a part of a turbine of a gas turbine engine with two embodiment variants of a rotor blade assembly group according to the invention.

In the different variants of a solution according to the invention, which are for example illustrated in FIG. 1 by way of example based on two rotor blade assembly groups 2*a* and 2*b* of the turbine TT, a considerable size reduction of the radially extending carrier sections 230 or 240 is achieved by providing a stiffening structure 5*a* or 5*b*. Each of the stiffening structures 5*a* or 5*b* has two ring-shaped stiffening elements in the form of (MMC) stiffening rings 50 and 51 that are arranged opposite each other at the face sides of the respective blade carrier 23 or 24. On the one hand, the stiffening rings 50 and 51 are directly connected to each other, preferably by means of at least one additional connection element. On the other hand, both stiffening rings 50, 51 respectively enclose one connection area 231 or 241 of the respective carrier section 230 or 240 in a form-fit manner at least in certain sections, with the carrier section 230 or 240 having a continuous profile in the circumferential direction that comprises at least two projections axially extending in opposite directions. Here, the connection area 231, 241 is respectively provided a firtree-shaped (cross sectional) profile. FIGS. 4C and 4D respectively show I-shaped and T-shaped cross-sectional profiles.

The two stiffening rings 50 and 51 of a rotor blade assembly group 2*a* or 2*b* that are arranged on face sides of a blade carrier 23 or 24 that are facing away from each other are connected to each other by means of respectively one connection appliance 6*a* or 6*b* and in the present case are fixated at each other as well as at the carrier section 230 or 240. At that, the respective connection appliance 6*a* or 6*b* comprises at least one separate connection element in the form of a stud bolt 60. This stud bolt 60 is provided, among other positions, above the respective connection area 231, 241 for the stiffening structure 5*a* or 5*b*. A nut 61 is screwed onto the stud bolt 60 for axial fixation. At that, the stud bolt 60 extends above the respective connection area 231, 241, among other positions respectively through a connection opening that is formed in an edge-side, radially protruding connecting web 50*a* or 50*b* of a stiffening ring 50 or 51, as well as through a connection opening 233 or 243 in the carrier section 230, 240.

Further, also a fixation of at least one connection components 7*a*, 7*b* at a blade carrier 23, 24 is realized by means of a stud bolt 60. In this manner, the individual rotor blade assembly groups 2*a*, 2*b* and 2*c* are connected to each other in a torque-proof manner via multiple sleeve-shaped connection components 7*a*, 7*b*. The rotor blade assembly groups 2*a* and 2*b* that are provided according to the invention with respectively one stiffening structure 5*a*, 5*b* are connected to each other in a torque-proof manner via a first sleeve-shaped connection component 7*a*, while the rotor blade assembly group 2*b* is connected in a torque-proof manner to the rear rotor blade assembly group 2*c* via a further, second sleeve-shaped connection component 7*b*. At their face sides, each of the sleeve-shaped connection components 7*a*, 7*b* has a ring-shaped flange section 70*a*, 70*b*. In the circumferential direction, this flange section 70*a* or 70*b* has multiple connection openings for fixation at the rotor blade assembly groups 2*a*, 2*b* and 2*c* which are arranged next to each other.

In the present case, it is provided with a view to a simplified mounting process and additional weight reduction as well as a more compact structure, that the connection components 7*a* and 7*b* at a rotor blade assembly group 2*a* or 2*b* are additionally fixated at the blade carriers 23 and 24 by means of a connection appliance 6*a* and 6*b*, via which the stiffening rings 5*a* and 5*b* are also fixated at each other and at the respective blade carrier 23 or 24. A single stud bolt 60 thus extends through the connection openings of the flange sections 70*a*, 70*b* and the stiffening rings 50, 51 as well as through a connection opening 233 or 243 of the respective blade carrier 23 or 24.

Figure 2:
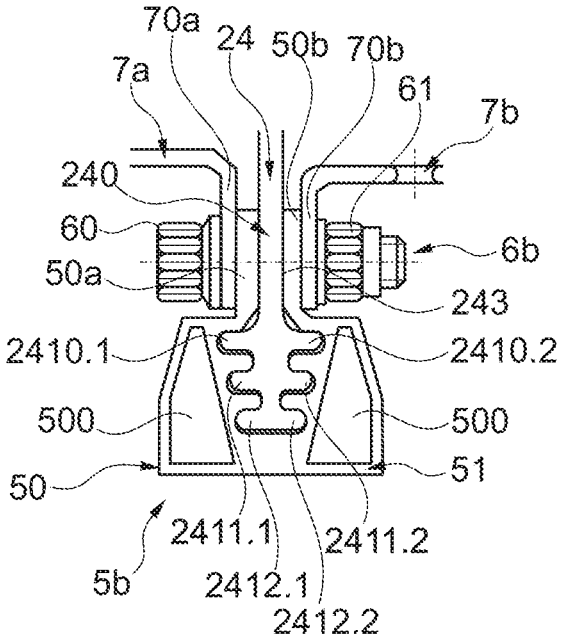
FIG. 2 shows an enlarged detailed view of a connection area of a blade carrier of the rotor blade assembly group with a stiffening structure fixated thereat as well as a connection to two front and rear rotor blade assembly groups that are respectively arranged in an axially offset manner.

As can also be seen in the enlarged rendering of FIG. 2, the connecting webs 50*a* and 50*b* of the stiffening rings 50 and 51 are thus fixated in a sandwiched manner between the flange sections 70*a* and 70*b*. Likewise, a part of the carrier section of the respective blade carrier—shown as the carrier 240 of the blade carrier 24 in FIG. 2 by way of example—is arranged in a sandwiched manner between the connecting webs 50*a* and 50*b*.

At the circumferential side, the stiffening rings 50 and 51 are fixated at multiple positions by means of respectively one connection appliance 6*a* or 6*b* to at least one stud bolt 60 at blade carriers 23, 24 of different, respectively ring-segment-shaped or disc-segment-shaped design, wherein at least one sleeve-shaped connection component 7*a*, 7*b* is in turn fixated at these stiffening rings 50, 51 by means of the same stud bolt 60. This is schematically illustrated particularly in the front view of FIG. 3.

Figure 3:
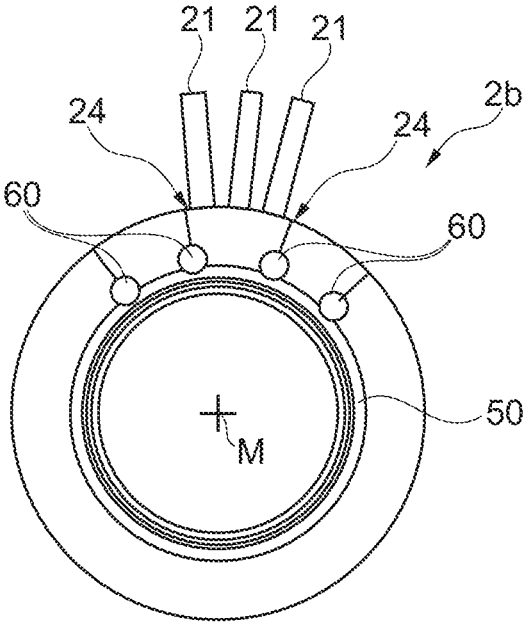
FIG. 3 shows a schematic front view of the rotor blade assembly group.

The rotor blade assembly group 2*b*, which is illustrated only schematically and by way of example in FIG. 3, has multiple respectively ring-segment-shaped or disc-segment-shaped blade carriers 24 with at least one rotor blade 21, in the present case three rotor blades 21 along a circumferential direction about the central axis M, so that the individual blade carriers 24 defined a circumferentially extending rotor blade row. In that case, the individual ring-segment-shaped or disc-segment-shaped blade carriers 24 are stiffened through respectively two stiffening rings 50 and 51 that are arranged at different face sides, and fixated relative to each other by means of the stud bolts 60 as well as in addition at the same time connected to at least one connection component 7*a* or 7*b*, via which in turn a torque-proof connection to a further rotor blade assembly group 2*a* or 2*c* is realized.

Figure 4A:
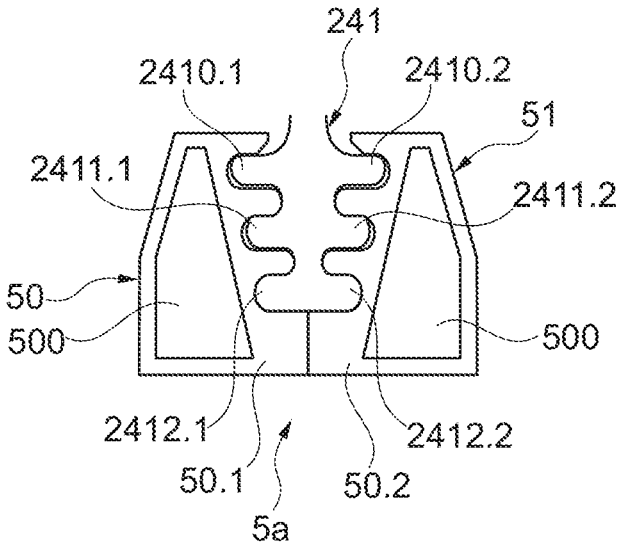
FIGS. 4A-4D show, in enlarged rendering and by sections, a connection area of a blade carrier with different variants of stiffening structures with MMC stiffening rings that are arranged thereat.
Figure 4B:
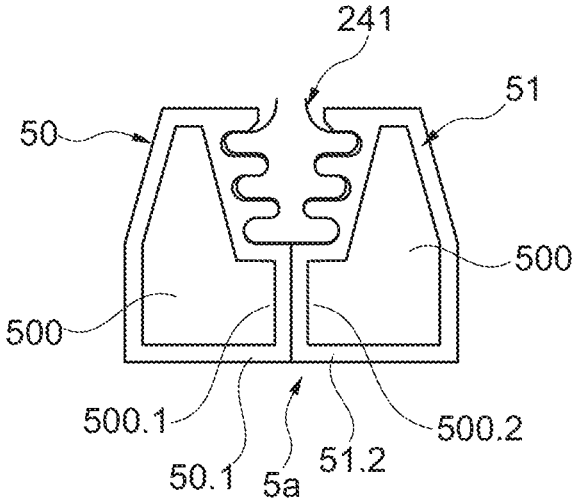
Figure 4C:
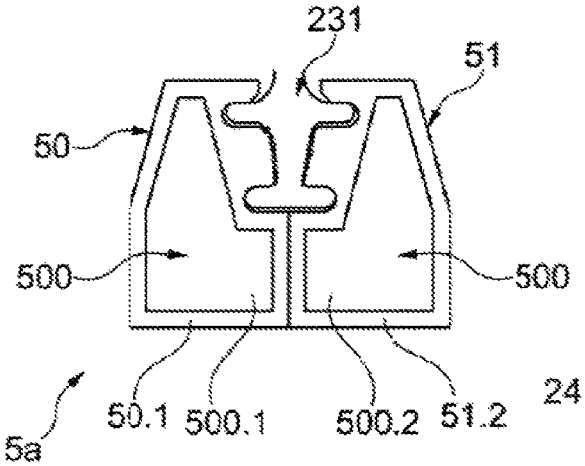
Figure 4D:
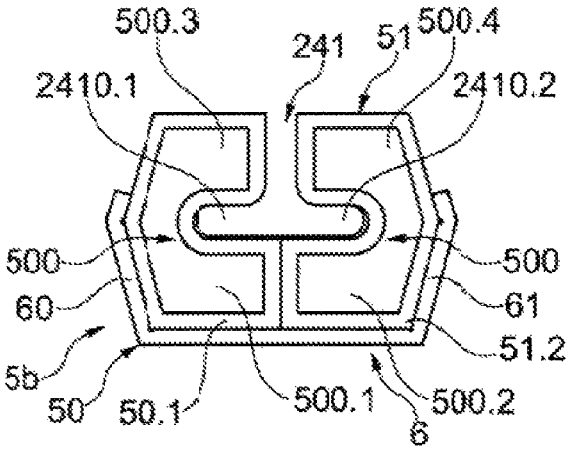

As is illustrated based on FIGS. 4A and 4B for different variants of the stiffening structures 5*a*, 5*b*, each stiffening ring 50, 51 of the respective stiffening structure 5*a* or 5*b* has a coated MMC core 500, for example a TiMMC core. By manufacturing the stiffening rings 50 and 51 in MMC design, a considerably increased stiffness of the blade carriers 23 or 24 is achieved, while at the same time they have a comparatively low weight. Here, a stiffening ring 50 or 51 extends with a enclosing section 50.1 or 51.2 axially below an edge of the connection area 231 or 241 that is facing towards the respective passage hole O1 or O2 in the direction of the other face side. Thus, each stiffening ring 50 or 51 at least partially encloses a radially internal edge of the respective blade carrier 23 or 24 in an L-shaped manner. In this manner, in particular the radial securing of the respective stiffening ring 50, 51 at the carrier section 230 or 240 is facilitated, and also a support of the blade carrier 23, 24 below of the connection area 231, 241 is achieved.

In the present case, both stiffening rings 50 and 51 extend so far axially below the inner edge of the carrier section 231 or 241 of the blade carrier 23 or 24 with respectively one enclosing section 50.1 or 51.2, that the stiffening rings 50 and 51 directly adjoin each other with their enclosing sections 50.1 and 51.2. Consequently, the stiffening rings 50 and 51 that are provided on both sides of the connection area 231 or 241 and that are respectively supported at the respective connection area 231 or 241 in a form-fit manner directly abut each other, and the stiffening structure 5*a* or 5*b* thus created extends completely through the passage hole O1 or O2.

The stiffening structure 5*a* or 5*b* with the stiffening rings 50 and 51, which are arranged at face sides of the blade carrier 23 or 24 that are facing away from each other, mainly receives radially acting forces. But at the same time, a simpler mounting as well as a simpler radial securing of the stiffening rings 50 and 51 to be mounted at the blade carrier 23 or 24 is facilitated as a result of the circumferentially extending profile of the connection area 231 or 241.

In a firtree-shaped cross sectional profile according to the variants of FIGS. 4A and 4B, the connection area 231, which is shown here by way of example, forms pairs of projections 2410.1/2410.2, 2411.1/2411.2 and 2412.1/2412.2 which axially extend in opposite directions. Each of these axial projections 2410.1 to 2412.2 protrudes in a ring-shaped manner at a face side of the carrier section 240. For forming the firtree-shaped profile, the axial length of the individual axial projections 2410.1 to 2412.1 or 2410.2 to 2412.2 decreases on each face side in the radial direction, in the present case radially inwards. Accordingly, a pair of axial projections 2412.1/2412.2, that is located closest to the passage hole O1, has the smallest axial extension, and the pairs of axial projections 2411.1/2411.2 and 2410.1/2410.2 that are arranged further radially outwardly respectively protrude further axially.

Provided at the individual stiffening rings 50 and 51 are grooves corresponding to the projections 2410.1 to 2312.1 or 2410.2 to 2412.2 of a face side, so that the stiffening ring 50 or 51 that is respectively attached at a face side encloses each projection 2410.1 to 2412.1 or 2410.2 to 2412.2 at the respective face side in a form-fit manner, and accordingly each projection 2410.1 to 2412.2 is respectively received between a radially further internally and a radially further externally positioned section of the respective stiffening ring 50 or 51. Through a form-fit connection between the blade carrier 24 and the stiffening rings 50 and 51 that is thus formed, radial loads as they occur during operation of the engine T are introduced into the stiffening structure 5*a* in a manner distributed across the firtree-shaped profile. In addition, the stiffening structure 5*a* is thus radially fixated at the carrier section 240 of the blade carrier 24 already by plugging on the stiffening rings 50, 51, without any additional fastening means.

In the embodiment variant of FIG. 4B, it is further provided that the MMC core 500 of a stiffening ring 50 or 51 extends below the inner edge of the carrier section 240 with at least one section 500.1 or 500.2 made of the metal matrix composite. Here, the MMC core has a substantially L-shaped cross section. In the variant of FIG. 2A, the MMC core 500 is thus arranged only axially next to the connection area 241 and in particular next to the projections 2410.1 to 2412.2. In contrast to that, in the variant of FIG. 2B, the MMC core 500 is arranged axially next to the connection area 241 and at least partially below the connection area 241, and accordingly in particular next to the projections 2410.1 to 2412.2 and at least partially below the projections 2410.1 to 2412.2.

Figure 5B:
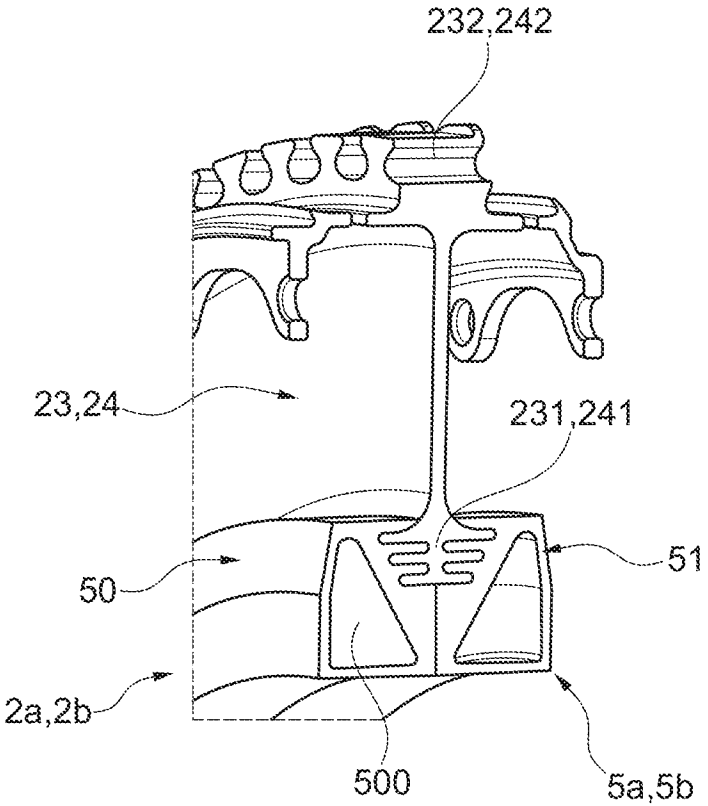
FIGS. 5A-5B show, by sections and in a sectioned perspective view, embodiment variants of a blade carrier of a rotor blade assembly group according to the invention with a firtree-shaped profile of the connection area, wherein, on the one hand, the blade carrier has rotor blades formed integrally therewith (FIG. 5A) and, on the other hand, is provided for separately manufactured rotor blades which are to be fixated thereat (FIG. 5B).
Figure 5A:
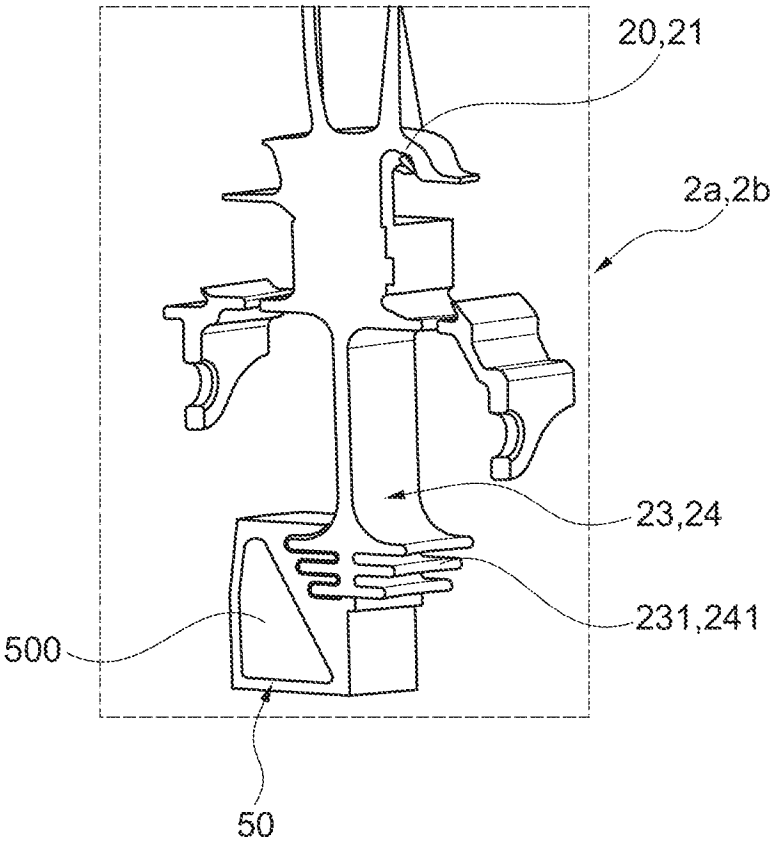

In FIGS. 5A and 5B, two different variants of the blade carrier 23, 24 of the rotor blade assembly group 2*a* or 2*b* are illustrated. In both variants, the blade carrier 23, 24 has a firtree-shaped cross sectional profile extending in the circumferential direction at the connection area 231 or 243 for the stiffening structure 5*a* or 5*b* and its stiffening rings 50 and 51 that are to be attached thereto. While in the variant of FIG. 5A, the ring segment-shaped or disc-segment-shaped blade carrier 23, 24 is embodied with rotor blades 20, 21 that are formed integrally thereat, the blade carrier 23, 24 of FIG. 5B has multiple fastening grooves 232, 242 arranged circumferentially next to each other for blade roots 200, 210 of the rotor blades 20, 21 that are to be fixated thereat.

Figure 6:
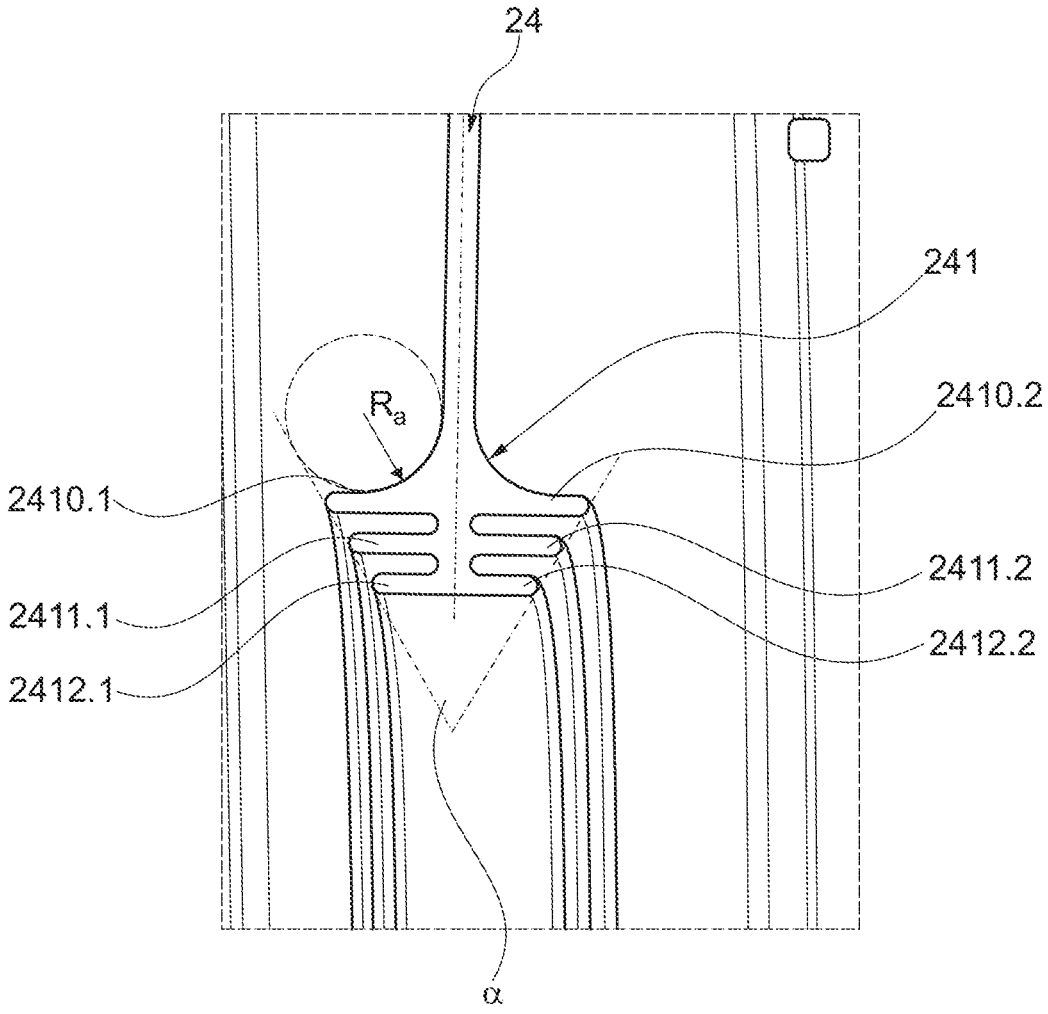
FIG. 6 shows, in a sectioned and enlarged view, a variant on a connection area of the blade carrier with a firtree-shaped profile.

Regarding a firtree-shaped profile of the connection area 241 of a blade carrier 24, it is further illustrated by way of example based on the cross sectional rendering of FIG. 6 which constructional parameters can be used, where necessary, to influence the connection between the blade carrier 24 and the stiffening rings 50, 51, and thus the force transmission into the stiffening structure 5*b*. For instance, in the present case, a radius Ra for a transitional area between a radially extending face surface of the carrier section 240 and a radially outermost projection 2410.1 of a face side is shown, based on the size of which the degree of concavity of the transitional area is influenced.

A geometry of the firtree-shaped profile can further be characterized by an angle $\alpha$ taken by two tangents with respect to each other, which are respectively applied in across the sectional view along the central axis M at the ends of the axial projections 2410.1 to 2412.1 or 2410.2 to 2412.2 of a face side. The larger the angle $\alpha$, the larger the axial extension of the firtree-shaped profile and/or the larger the gradation in the axial extension between the projections 2410.1 to 2412.1 or 2410.2 to 2412.2 that are provided at a face side.

PARTS LIST

11 low-pressure compressor
12 high-pressure compressor
13 high-pressure turbine
14 medium-pressure turbine
15 low-pressure turbine
20, 21, 22 rotor blade
200, 210, 220 blade root
23, 24, 25 blade carrier
230, 240, 250 carrier section
231 connection area
232, 242 connection groove
233, 243 connection opening
241 connection area
2410.1, 2410.2, axial projection
2411.1, 2411.2,
2412.1, 2412.2
2*a*, 2*b*, 2*c* rotor blade assembly group
30, 31 guide vane
4.1, 4.2 flange connection
50, 51 stiffening ring (stiffening element)
50.1, 51.2 enclosing section
500 MMC core
500.1, 500.2, MMC section
50*a*, 50*b* connecting web
5*a*, 5*b* stiffening structure

60 stud bolt
61 nut
6*a*, 6*b* connection appliance
70*a*, 70*b* flange section
7*a*, 7*b* connection component (sleeve-shaped/sleeve-segment-shaped)
A outlet
B bypass channel
BK combustion chamber section
C outlet cone
E inlet/intake
F fan
FC fan housing
M central axis/rotational axis
O1, O2 passage hole
R entry direction
Ra radius
S rotor shaft
T turbine engine (gas turbine engine)
TT turbine
V compressor
α angle

The invention claimed is:

1. A rotor blade assembly group for an engine, comprising:

a blade carrier including a plurality of rotor blades that are provided along a first circle line about a central axis of the rotor blade assembly group, the blade carrier including a carrier section that extends radially inward in a direction toward the central axis with respect to the plurality of rotor blades, the carrier section comprising a connection area positioned at a radially innermost portion of the carrier section farthest from the plurality of rotor blades, at least one stiffening ring fixedly attached at the connection area of the carrier section, the at least one stiffening ring being arranged at a first or a second face side of the blade carrier, the blade carrier being formed in a ring-segment-shaped or a disc-segment-shaped manner, the connection area of the carrier section including a profile that includes at least one axial projection, with the profile having a T-shaped, I-shaped, or fir tree shaped cross-section, the at least one stiffening ring engaging around the profile in a form-fit manner, such that the at least one axial projection is received at least partially between a radially outer section and a radially inner section of the at least one stiffening ring, and a sleeve-shaped connection component for connecting the blade carrier to at least one other adjacent blade carrier via a bolt connection element, and such that the bolt connection element connects the sleeve-shaped connection component and an extension of the at least one stiffening ring to the blade carrier, wherein the blade carrier includes a passage hole that extends axially with respect to the central axis and that is radially delimited by a radially innermost edge of the carrier section, and a portion of the radially inner section of the at least one stiffening ring axially extends radially inwardly of the radially innermost edge of the carrier section and is positioned directly radially between the central axis and the radially innermost edge of the carrier section.

2. The rotor blade assembly group according to claim 1, wherein:

the at least one stiffening ring includes a first stiffening ring and a second stiffening ring, the first stiffening ring and the second stiffening ring fixedly attached at the connection area of the carrier section, the first stiffening ring is arranged at the first face side of the blade carrier and the second stiffening ring is arranged at the second face side of the blade carrier, such that the second face side is facing away from the first face side, and the first and second stiffening rings are connected to the connection area of the carrier section and in addition are connected to each other.

3. The rotor blade assembly group according to claim 2, wherein at least one of the first stiffening ring and the second stiffening ring is made of a metal matrix composite.

4. The rotor blade assembly group according to claim 2, wherein at least one of the first stiffening ring and the second stiffening ring includes an internal core made of a metal matrix composite.

5. The rotor blade assembly group according to claim 4, wherein the at least one stiffening ring that includes the internal core made of the metal matrix composite is configured such that the internal core made of the metal matrix composite axially extends radially inwardly of the radially innermost edge of the carrier section and is positioned directly radially between the central axis and the radially innermost edge of the carrier section.

6. The rotor blade assembly group according to claim 1, wherein the profile of the connection area of the carrier section that has the T-shaped, I-shaped, or fir tree shaped cross-section extends along a second circle line about the central axis of the rotor blade assembly group at least in certain sections.

7. A gas turbine engine with at least one rotor blade assembly group according to claim 5.

* * * * *